United States Patent [19]

Broersma

[11] 4,002,863

[45] Jan. 11, 1977

[54] TRANSDUCER AND METHOD OF MAKING SAME

[76] Inventor: Harmen Broersma, Stoombootweg 9, Amsterdam-N., Netherlands

[22] Filed: Dec. 2, 1974

[21] Appl. No.: 528,803

[52] U.S. Cl. ..... 179/180; 24/594

[51] Int. Cl.[2] ..... H04R 1/28; H04R 31/00

[58] Field of Search ..... 179/110 A, 114 A, 115 R, 179/115 A, 119 A, 107 R, 178, 180; 29/594

[56] References Cited

UNITED STATES PATENTS

| | | | |
|---|---|---|---|
| 2,305,369 | 12/1942 | Williams | 179/110 A |
| 2,400,281 | 5/1946 | Anderson | 179/115 A |
| 2,552,800 | 5/1951 | Lybarger | 179/115 R |
| 2,638,508 | 5/1953 | Carlisle | 179/110 A |
| 2,774,438 | 12/1956 | Bauer | 179/180 |

FOREIGN PATENTS OR APPLICATIONS

| | | | |
|---|---|---|---|
| 70,526 | 5/1959 | France | 179/115 A |
| 1,287,134 | 1/1969 | Germany | 179/110 A |
| 6,602,799 | 9/1967 | Netherlands | 179/180 |
| 1,206,917 | 9/1970 | United Kingdom | 179/119 A |

*Primary Examiner*—George G. Stellar
*Attorney, Agent, or Firm*—Walter Becker

[57] ABSTRACT

A transducer and method of making same, according to which an electro-mechanical motor is mounted in a housing. A partition divides the housing into a first and second chamber. The partition is provided with a passage through which a linkage pin extends connecting the motor comprising an armature arranged in the first chamber with a vibration diaphragm mounted in the second chamber. The diaphragm divides off the second chamber, a further chamber contiguous to the partition.

2 Claims, 8 Drawing Figures

TRANSDUCER AND METHOD OF MAKING SAME

The invention relates to a transducer consisting of an electromechanical motor, mounted in a housing which is divided by a partition into a first and second chamber of the transducer. This partition is provided with an opening. A linkage pin projects through the opening and connects the armature of said motor mounted in said first chamber with a vibration diaphragm mounted in the second chamber. The diaphragm partitions a space contiguous with said partition from said second chamber.

A disadvantage of this known sort of transducers consists in the difficulty of attaining a degree of damping of the resonant frequency in a precise and reproducible way. More specifically, the difficulty consists in that the annular space, formed by the opening in the partition and the linkage pin projecting therethrough, at least when manufacturing on a commercial scale, not always acquires the desired micro-dimensions. As a result thereof considerable research has been conducted to find other means by which, in spite of the inaccuracy of the passage through the partition, satisfactory damping can be obtained. These various other known damping means, as for instance silicone pastes or tissues applied to the armature near the openings for the acoustical transmission in the transducer, however, have always led to a decrease in the reproductive quality of the apparatus.

This is of even greater importance when the transducer is being used as a miniature receiver for a hearing aid.

It is an object of the present invention to provide a solution to the above mentioned difficulties and to avoid the above outlined disadvantages. These and other objects and advantages of the invention will appear more clearly from the following specification in connection with the accompanying drawing, in which.

A transducer according to the invention is characterized primarily in that said opening is provided in a foil forming a part of the partition, which foil surrounds the linkage pin in an at least substantially acoustically tight manner. In this way the problem of dimensioning an annular opening in a very accurate way is avoided. The construction according to the invention lends itself very well also to an application in miniature receivers on a commercial scale.

The invention lends itself also very well to obtaining various desired rates of damping in a miniature receiver on a very accurately commercially reducible scale. Furthermore, in an applied foil according to the invention, it is easy and always possible to obtain the desired play between the edges of the opening and the outer surface of the linkage pin. Further, it is possible in the foil, at a distance from the central opening which is completely or nearly completely closed off by the linkage pin, to make one or more extra holes of micro-dimensions. As far as the technical possibilities, in relation to the desired dimensions of said extra hole will allow, these openings can also, in an effective way, be made in the partition itself.

The invention relates also to a method for manufacturing the transducer according to the invention. This method is characterized primarily in that a complete acoustical seal of the opening is acquired by choosing the dimensions of the linkage pin and the dimensions of the opening in the foil. Thus the linkage pin, after being mounted with a clamping fit in the opening, by way of the initial putting into operation of the electromechanical motor after mounting, there will occur that the opening and the linkage pin wear each other out until they are just free of play by the relative movement of the linkage pin and the clamping edges of the opening. Of course the choice of the type of material of the linkage pin and of the foil should be such, that enough abrasion occurs to acquire this mutual wearing out.

This invention lends itself also to a method of manufacturing the transducer according to the invention, according to which, for connecting the linkage pin to the armature or to the vibration diaphragm, the linkage pin is brought into the position in which it projects through the opening in the foil, for reason of attaining an exact positioning, after which the linkage pin is connected to the armature or to the vibration diaphragm.

In a preferred embodiment of the invention the foil is formed by a central thinned out part of this partition, said central thinned out part forming an integral part of the partition.

Figure 1:
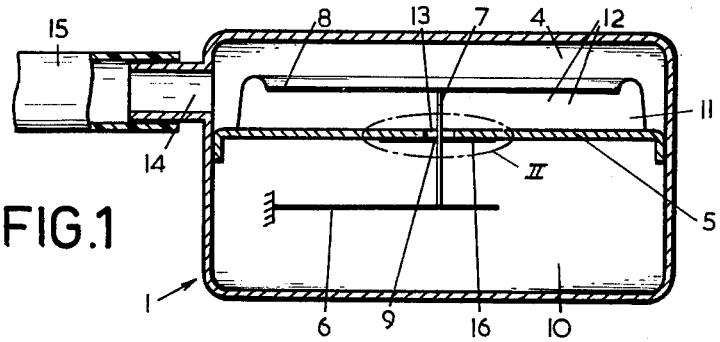
FIG. 1 is a vertical cross section through the acoustical part of a transducer according to the invention.
Figure 2:
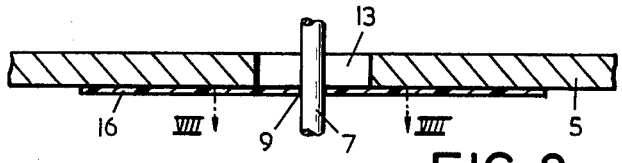
FIG. 2 illustrates on a scale larger than that of FIG. 1 that portion of the latter which is encircled by the dot-dash ellipse shown in FIG. 1.

Referring now to the drawing in detail, FIG. 1 shows a housing 1 of a transducer. This housing 1 is partitioned by a partition 5 into a first chamber 10 and a second chamber 12. In the first chamber 10 there is mounted an armature 6, whereas in the second chamber 12 a vibration diaphragm 8 is provided. This vibration diaphragm 8 defines a room 11 which is contiguous to the partition 5. The other room 4 of the chamber 12 is acoustically connected with the tubing 15 via a nipple 14. Tubing 15 serves for connection with the ear canal of the user. A linkage pin 7, (see also FIG. 2) serves for transmitting the movement of the armature 6 relative to the vibration diaphragm 8. The partition 5 has an opening 13 for passage of the linkage pin 7. According to the invention, the opening 13 is provided with a foil 16, which foil 16 seals the opening 13 acoustically tight and also seals the passage for the linkage pin 7 through said foil 16. Due to the acoustical seal between the chamber 10 and the chamber 11, the highest possible acoustical resistance is obtained.

Figure 4:
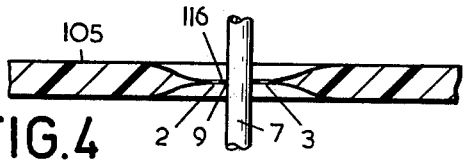
FIG. 4 is a vertical cross section similar to that of FIG. 2, but differs therefrom in that the partition and the foil form a single integral part.
Figure 6:
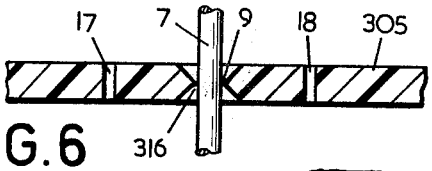
FIG. 6 shows a second modification of the embodiment of FIG. 4.

In conformity with this construction it is now possible accurately and reproducibly to make the desired holes for damping at a distance from the opening 9, see FIG. 4, holes 2 and 3, and FIG. 6, holes 17 and 18.

Figure 3:
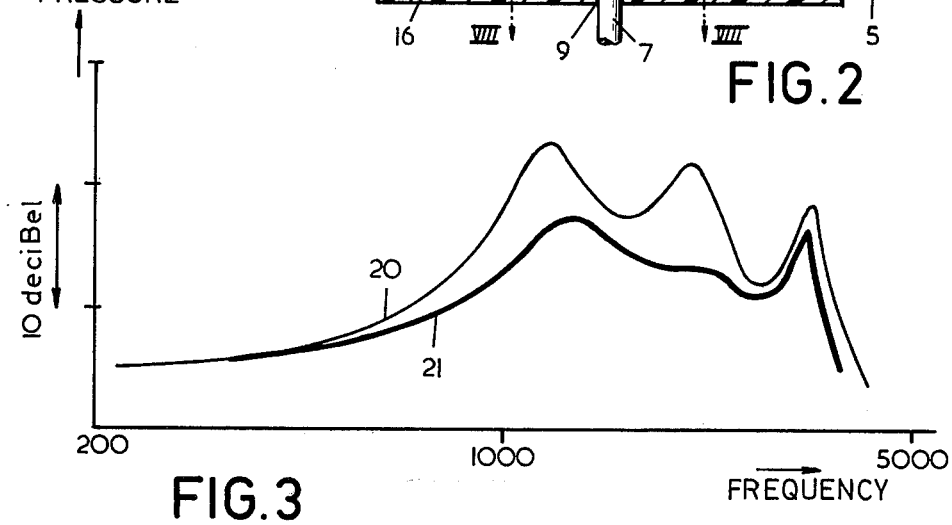
FIG. 3 illustrates by way of a diagram a comparison of the acoustical damping of a known type receiver with the damping of a receiver according to the invention.

In FIG. 3, the amplitude-frequency curve 20 of a known type of receiver is shown in comparison to an amplitude-frequency curve 21 of a receiver according to the invention.

In FIG. 4 an embodiment of a partition formed as one piece with a foil is shown. The partition 105 has, in its central part, a very thin foil part 116. FIG. 4 shows how for obtaining a required rate of damping, holes 2 and 3 can be made in the foil part 116.

Figure 5:
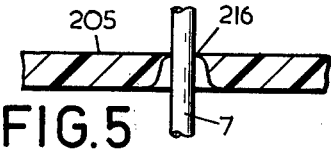
FIG. 5 shows a modification over the embodiment in FIG. 4.

In FIG. 5 a second embodiment is shown of an integrally formed partition 205 and foil 216.

In FIG. 6 a third embodiment of an integrally formed partition 305 and foil 316 is shown. In this FIG. 6 further are shown holes 17 and 18, which serve for regulating the required acoustical damping.

Figure 7:
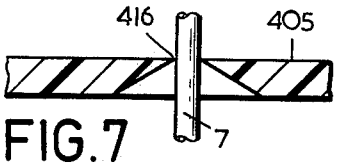
FIG. 7 illustrates a third modification of the embodiment of FIG. 4.

FIG. 7 shows an integrally formed partition 405 and foil 416, which foil 416 in this instance is formed by a very sharp edge.

Figure 8:
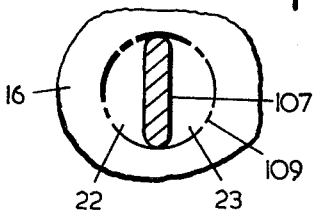
FIG. 8 is a cross section along the lines VIII—VIII of FIG. 2 on a larger scale than that of the latter, and with an opening of the foil with the linkage pin projecting therethrough, whereby the dimensions of the opening are larger than those of the cross section of the linkage pin in this area.

FIG. 8 illustrates how a linkage pin 107 with an elongated cross section projects through a round opening 109 by which extra holes 22 and 23 are formed, which holes 22 and 23 now are contiguous with the opening 109 through which the linkage pin 107 projects, said holes 22 and 23 serving for acoustical damping.

As a material for a partition and for a foil a metal-like aluminum as well as a synthetic material, like a polyamide may be selected.

In each of the above mentioned embodiments for the opening in the foil an opening 9, 109 may be selected which is smaller than the cross section of the linkage pin 7, 107 in the area where this linkage pin 7, 107 projects through the opening 9, 109. When initially putting the receiver in use, which generally is done during the manufacturing period, the material of the foil 116, 216, 316, 416 and/or the material of the linkage pin 7, 107 wear quickly in such a way that an exact opening without play, but also with a frictionless fit is obtained.

On the other hand, such material may be selected for the foil and the linkage pin that these parts will exert a very low friction upon each other. In such an instance, the dimensions of the opening and of the linkage pin are right from the start so selected that immediately a very accurate gliding fit is obtained.

It is, of course, to be understood that the present invention is, by no means, limited to the specific showing in the drawing, but also comprises any modifications within the scope of the appended claims. Thus, for instance, for the embodiment shown in FIG. 8, an opening may be provided which surrounds the linkage pin in still other ways with a certain play, for instance by choosing a square form for the opening and a round cross section for the linkage pin.

What I claim is:

1. A method of making a hearing aid comprising a miniature transducer having a housing, an electromechanical motor in said housing, a partition subdividing said housing and having associated therewith a foil with a passage therethrough, and a linkage pin extending through said passage, which includes the steps of placing said linkage pin into said opening with clamping fit, and selecting the material of the linkage pin and said foil so that after initiating the operation of said electromechanical motor the outer surface of said linkage pin and the edges of said opening will wear each other out until they are just free of play.

2. A method according to claim 1, in which the electro-mechanical motor includes an armature on one side of said foil while a vibration diaphragm is arranged on the other side of said foil, which includes the step of selectively connecting said linkage pin to the armature and the vibration diaphragm.

* * * * *